US011566843B2

(12) United States Patent
Dillon et al.

(10) Patent No.: US 11,566,843 B2
(45) Date of Patent: Jan. 31, 2023

(54) KLIN FIRING WITH DIFFERENTIAL TEMPERATURE GRADIENTS

(71) Applicant: CORNING INCORPORATED, Corning, NY (US)

(72) Inventors: Gregory Paul Dillon, Horseheads, NY (US); Bernd Geismar, Berlin (DE); Michael Gerigk, Niedermohr (DE); Thomas Madison Tebo, III, Horseheads, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 17/499,385

(22) Filed: Oct. 12, 2021

(65) Prior Publication Data

US 2022/0026148 A1 Jan. 27, 2022

Related U.S. Application Data

(63) Continuation of application No. 16/069,749, filed as application No. PCT/US2017/013411 on Jan. 13, 2017, now Pat. No. 11,168,941.

(Continued)

(51) Int. Cl.
*F27B 9/04* (2006.01)
*F27B 9/10* (2006.01)

(Continued)

(52) U.S. Cl.
CPC ..... *F27B 9/045* (2013.01); *B28B 11/243* (2013.01); *F27B 9/10* (2013.01); *F27B 9/40* (2013.01);

(Continued)

(58) Field of Classification Search
None
See application file for complete search history.

(56) References Cited

U.S. PATENT DOCUMENTS 4,416,624 A 11/1983 Bloom
5,613,847 A 3/1997 Lingl (Continued)

FOREIGN PATENT DOCUMENTS

CN 1282412 A 1/2001
CN 202420158 U 9/2012

(Continued)

OTHER PUBLICATIONS

Chinese Patent Application No. 201780006892.8; English Translation of the Second Office Action dated Oct. 29, 19; China Patent Office; 12 pgs.

(Continued)

*Primary Examiner* — Michael P. Rodriguez
(74) *Attorney, Agent, or Firm* — Daniel J. Greenhalgh

(57) ABSTRACT

A method for heating ware in a kiln. The ware space of the kiln includes a plurality of temperature control zones oriented in a first direction, and a plurality of temperature control zones oriented in a second direction. The method includes heating the ware space in a first heating stage, a second heating stage, and a third heating stage. At least one of the following conditions is satisfied: (i) in one of the heating stages, a temperature control zone oriented in the first direction has a setpoint temperature that is different from a setpoint temperature of one other temperature control zone oriented in the first direction; and (ii) in one of the heating stages, one temperature control zone oriented in the second direction has a setpoint temperature that is different from a setpoint temperature of one other temperature control zone oriented in the second direction.

7 Claims, 4 Drawing Sheets

Related U.S. Application Data

(60) Provisional application No. 62/279,386, filed on Jan. 15, 2016.

(51) Int. Cl.

| | |
|---|---|
| ***F27B 9/40*** | (2006.01) |
| ***F27B 17/00*** | (2006.01) |
| ***F27D 19/00*** | (2006.01) |
| ***F27D 99/00*** | (2010.01) |
| ***B28B 11/24*** | (2006.01) |

(52) U.S. Cl.

CPC ..... *F27B 17/0041* (2013.01); *F27D 19/00* (2013.01); *F27D 99/0033* (2013.01); *F27D 2019/0003* (2013.01); *F27D 2019/0018* (2013.01); *F27D 2019/0034* (2013.01); *F27D 2019/0093* (2013.01)

(56) References Cited

U.S. PATENT DOCUMENTS

| | | | |
|---|---|---|---|
| 6,048,199 | A | 4/2000 | Dull et al. |
| 6,325,963 | B1 | 12/2001 | Dull et al. |
| 6,511,628 | B2 | 1/2003 | Gheorghiu et al. |
| 6,730,885 | B2 | 5/2004 | Suzuki et al. |
| 7,238,319 | B2 | 7/2007 | Brennan et al. |
| 2002/0008334 | A1 | 1/2002 | Gheorghiu et al. |
| 2008/0116621 | A1 | 5/2008 | Brennan et al. |
| 2010/0127418 | A1 | 5/2010 | Davidson et al. |
| 2012/0217669 | A1 | 8/2012 | Balster et al. |
| 2014/0131926 | A1 | 5/2014 | Geismar et al. |

FOREIGN PATENT DOCUMENTS

| | | | |
|---|---|---|---|
| CN | 103429553 | A | 12/2013 |
| CN | 103822474 | A | 5/2014 |
| EP | 2584299 | A1 | 4/2013 |
| JP | 04-273983 | A | 9/1992 |
| JP | 2002-025997 | A | 1/2002 |
| JP | 2005-077001 | A | 3/2005 |
| JP | 2006-089338 | A | 4/2006 |
| JP | 2014-512320 | A | 5/2014 |
| WO | 2001/063194 | A1 | 8/2001 |
| WO | 2010/065370 | A1 | 6/2010 |

OTHER PUBLICATIONS

English Translation of CN20178006892.8 First Office Action dated May 15, 2019, China Patent Office 12 pgs.

European Patent Application No. 17703833.8; Notice of Allowance dated Oct. 7, 2019; European Patent Office; 7 pgs.

International Search Report and Written Opinion of the International Searching Authority; PCT/US2017/013411; dated Apr. 13, 2017; 16 Pages; European Patent Office.

Japanese Patent Application No. 2018536722; Notice of Allowance dated Mar. 4, 2020; Japan Patent Office; 3 pgs.

Nemeth et al; "Designing Ceramic Components for Durability", American Ceramic Society Bulletin, vol. 72, No. 12, Dec. 1993, pp. 59-69.

KLIN FIRING WITH DIFFERENTIAL TEMPERATURE GRADIENTS

CROSS-REFERENCE TO RELATED APPLICATIONS

This application is a Continuation of U.S. application Ser. No. 16/069,749 filed on Jan. 13, 2017, which claims the benefit of International Application No. PCT/US2017/013411 filed on Jan. 13, 2017, claims the benefit of priority of U.S. Provisional Application Ser. No. 62/279,386 filed on Jan. 15, 2016, the content of which is relied upon and incorporated herein by reference in its entirety.

BACKGROUND

Field

The present specification generally relates to firing and kilns such as to produce ceramic articles. More specifically, the present specification relates to imposed differential temperature gradients in a kiln's ware space, such as a periodic kiln, for example to control reaction rates while firing ware made of ceramic and/or ceramic-forming material.

Technical Background

In conventional firing cycles burners in a ware space are fired to keep the temperature of the ware space uniform, and intentional temperature gradients within the ware space are avoided. A problem associated with firing ware with conventional firing cycles is that uncontrolled temperature differentials within the kiln may form. For example, ware containing organic compounds that are removed by partial decomposition and/or oxidation during the firing cycle tend to produce large amounts of exothermic heat. Exothermic heat can produce an uncontrolled temperature differential within the kiln that can cause non-uniform firing of the ware. In addition, oxygen present in the atmosphere tends to react with the organic compounds thereby accelerating release and increasing the exothermic reaction. Large, uncontrolled temperature differentials within kiln can make it difficult to control the temperature of the ware within the kiln, and can cause the ware to fire non-uniformly and/or crack.

SUMMARY

According to one embodiment, a method for firing ware in a periodic kiln is provided. The method comprises positioning at least one stack of ware in a ware space of the periodic kiln. The ware space comprises a plurality of temperature control zones that are oriented in a first direction, and a plurality of temperature control zones that are oriented in a second direction. The method further comprises heating the ware space in a first heating stage from an ambient temperature to a first temperature that is greater than the ambient temperature, heating the ware space in a second heating stage from the first temperature to a second temperature that is greater than the first temperature, and heating the ware space in a third heating stage from the second temperature to a top soak temperature that is greater than the second temperature. In the method at least one of the following conditions is satisfied: (i) during at least one of the first heating stage, the second heating stage, and the third heating stage, one temperature control zone of the plurality of temperature control zones that are oriented in the first direction has a setpoint temperature that is different from a setpoint temperature of at least one other temperature control zone of the plurality of temperature control zones that are oriented in the first direction; and (ii) during at least one of the first heating stage, the second heating stage, and the third heating stage, one temperature control zone of the plurality of temperature control zones that are oriented in the second direction has a setpoint temperature that is different from a setpoint temperature of at least one other temperature control zone of the plurality of temperature control zones that are oriented in the second direction.

In another embodiment, a method for firing ware in a down-draft periodic kiln is provided. The method comprises positioning at least one stack of ware in a ware space of the down-draft periodic kiln. In some embodiments, the ware space is defined by: a crown; a hearth opposite the crown; a first sidewall spanning between the crown and the hearth; a second sidewall opposite the first sidewall and spanning between the crown and the hearth, a front wall bounded by the first sidewall, the second sidewall, the hearth, and the crown; a back wall opposite the front wall and bounded by the first sidewall, the second sidewall, the hearth, and the crown. The ware space can comprise: a plurality of temperature control zones that are oriented in a vertical direction, and a plurality of temperature control zones that are oriented in a horizontal direction. The method further comprises heating the ware space in a first heating stage from an ambient temperature to a first temperature that is greater than the ambient temperature, heating the ware space in a second heating stage from the first temperature to a second temperature that is greater than the first temperature, and heating the ware space in a third heating stage from the second temperature to a top soak temperature that is greater than the second temperature. In the method at least one of the following conditions is satisfied: (i) during at least one of the first heating stage, the second heating stage, and the third heating stage, one temperature control zone of the plurality of temperature control zones that are oriented in the vertical direction has a setpoint temperature that is different from a setpoint temperature of at least one other temperature control zone of the plurality of temperature control zones that are oriented in the vertical direction; and (ii) during at least one of the first heating stage, the second heating stage, and the third heating stage, one temperature control zone of the plurality of temperature control zones that are oriented in the horizontal direction has a setpoint temperature that is different from a setpoint temperature of at least one other temperature control zone of the plurality of temperature control zones that are oriented in the horizontal direction.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
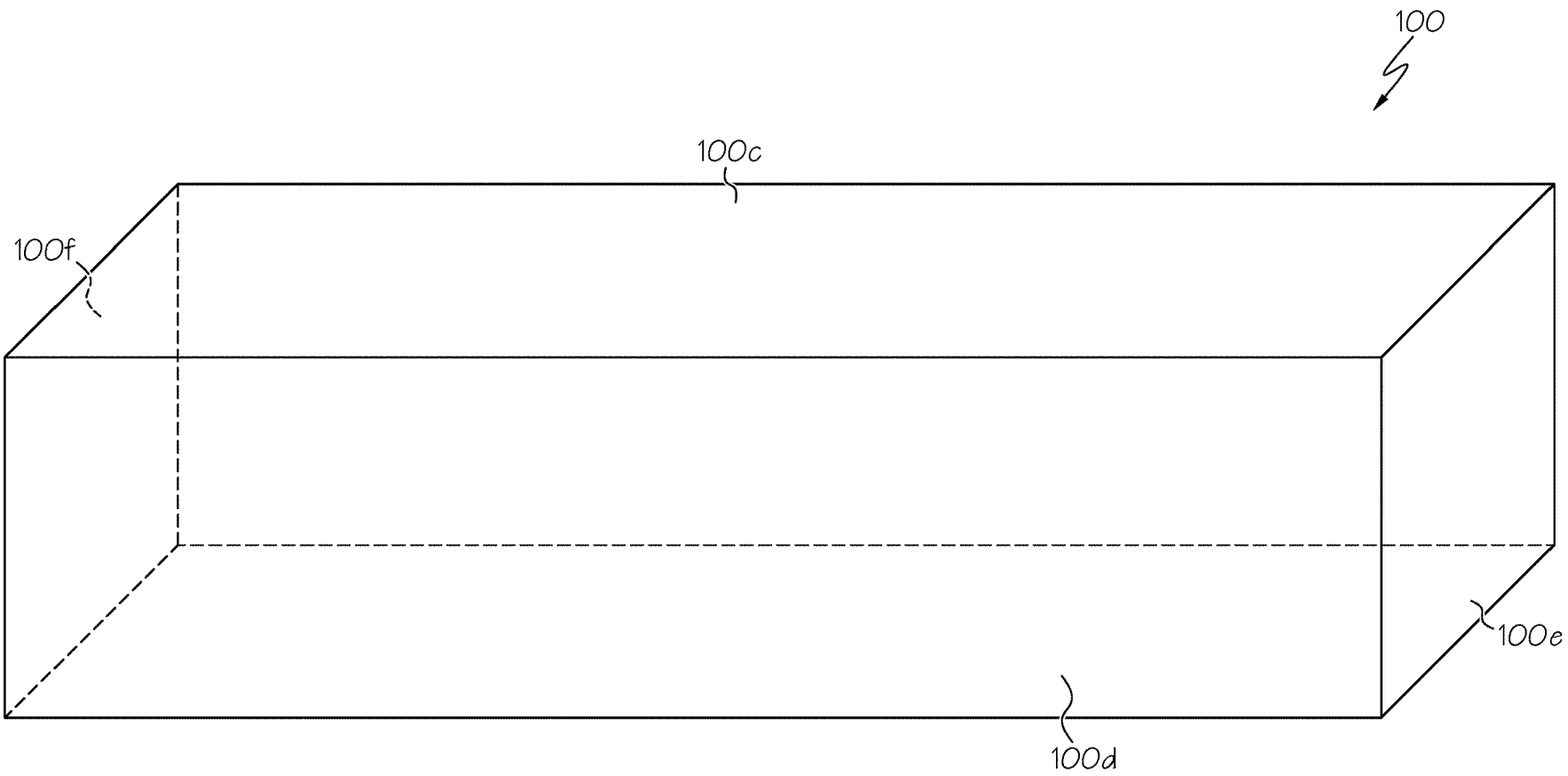
FIG. 1 schematically depicts the outside of a periodic down draft kiln according to embodiments disclosed and described herein.

Reference will now be made in detail to embodiments of systems for and methods of applying or imposing differential temperature gradients within the ware space of a periodic kiln, embodiments of which are illustrated in the accompanying drawings. Whenever possible, the same reference numerals will be used throughout the drawings to refer to the same or like parts. In one embodiment, a method for firing ware in a periodic kiln is provided. The method comprises positioning at least one stack of ware in a ware space of the periodic kiln. The ware space comprises a plurality of temperature control zones that are oriented in a first direction, and a plurality of temperature control zones that are oriented in a second direction. The method further comprises heating the ware space in a first heating stage from an ambient temperature to a first temperature that is greater than the ambient temperature, heating the ware space in a second heating stage from the first temperature to a second temperature that is greater than the first temperature, and heating the ware space in a third heating stage from the second temperature to a top soak temperature that is greater than the second temperature. In the method at least one of the following conditions is satisfied: (i) during at least one of the first heating stage, the second heating stage, and the third heating stage, one temperature control zone of the plurality of temperature control zones that are oriented in the first direction has a setpoint temperature that is different from a setpoint temperature of at least one other temperature control zone of the plurality of temperature control zones that are oriented in the first direction; and (ii) during at least one of the first heating stage, the second heating stage, and the third heating stage, one temperature control zone of the plurality of temperature control zones that are oriented in the second direction has a setpoint temperature that is different from a setpoint temperature of at least one other temperature control zone of the plurality of temperature control zones that are oriented in the second direction. Various systems for and methods of applying or imposing differential temperature gradients within the ware space of a periodic kiln will be described herein with specific reference to the appended figures. Although the figures depict a kiln that burns fuel, an electric kiln could be used in embodiments to create the temperature gradients disclosed and described herein.

Figure 2:
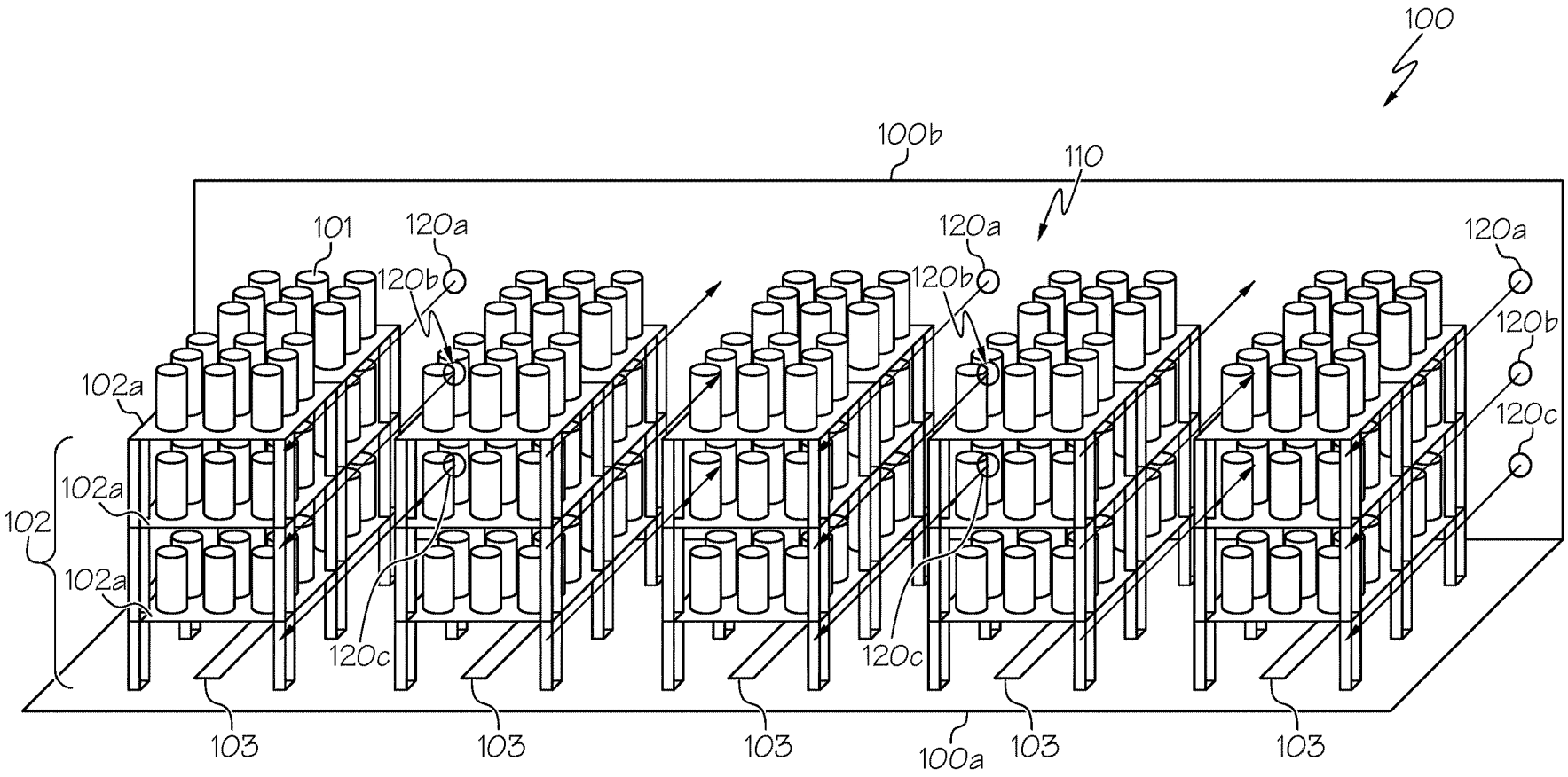
FIG. 2 schematically depicts the inside of a periodic down draft kiln loaded with ware according to embodiments disclosed and described herein.

A periodic kiln according to embodiments that is configured to provide desired differential temperature gradients to be applied to or imposed within the ware space of a periodic kiln is described below in reference to FIG. 1 and FIG. 2. FIG. 1 schematically depicts the outside of a periodic kiln 100, and FIG. 2 schematically depicts the inside of a periodic kiln 100. In embodiments, and with reference to FIG. 1 and FIG. 2, the periodic kiln 100 comprises a crown 100*c* at the top of the periodic kiln 100, a hearth 100*a* at the bottom of the periodic kiln 100 and opposite the crown 100*c*. The periodic kiln 100 also comprises a first sidewall 100*b* and a second sidewall 100*d* opposite the first sidewall 100*b* and spanning between the hearth 100*a* and the crown 100*c*. The periodic kiln 100 further comprises a front wall 100*e* on one side of the periodic kiln 100 and spanning between the crown 100*c*, the hearth 100*a*, the first sidewall 100*b*, and the second sidewall 100*d*. The periodic kiln 100 also comprises a back wall 100*f* opposite the front wall 100*e* and spanning between the crown 100*c*, the hearth 100*a*, the first sidewall 100*b*, and the second sidewall 100*d*. The space encompassed by the hearth 100*a*, crown 100*c*, first sidewall 100*b*, second sidewall 100*d*, front wall 100*e*, and back wall 100*f* defines a ware space 110 in which ware 101 and stacks 102 to support the ware 101 are loaded into the periodic kiln 100. In some embodiments, the kiln comprises a plurality of walls defining a ware space, and a multi-zone gas distribution delivery subsystem configured to deliver a plurality of gas flows to respective portions of the ware space; for example, the plurality of walls comprises at least a portion of a hearth, a crown, a first sidewall, a second sidewall, a front wall, and a back wall.

In the embodiment depicted in FIG. 2, individual pieces of ware 101 are loaded onto a plurality of stacks 102. The number of ware 101 that may be loaded onto each stack 102 is not limited and the ware 101 may be loaded onto the stack 102 in any configuration. In embodiments, the ware 101 is loaded onto each stack 102 so that the individual pieces of ware 101 are spaced apart allowing gases to flow between the individual pieces of ware 101 while they are resting on the stacks 102. In the embodiment depicted in FIG. 2, each stack 102 comprises three shelves 102*a* that holds a plurality of ware 101. However, in embodiments, the number of shelves 102*a* for each stack 102 is not limited and may vary according to embodiments. In embodiments, the ware 101 may be loaded onto the stack 102 while the stack 102 is in the ware space of the periodic kiln 100, such as between firing cycles when the ware space 110 and the stacks 102 have cooled. In other embodiments, the stack 102 is loaded with ware 101 outside of the periodic kiln 100 and then the loaded stack is transferred into the ware space 110 of the periodic kiln 100. In embodiments where the loaded stack is transported into the periodic kiln 100, the stack 102 may be moved to and from the periodic kiln 100 on carts (not shown) or by other conveyance method.

Figure 3:
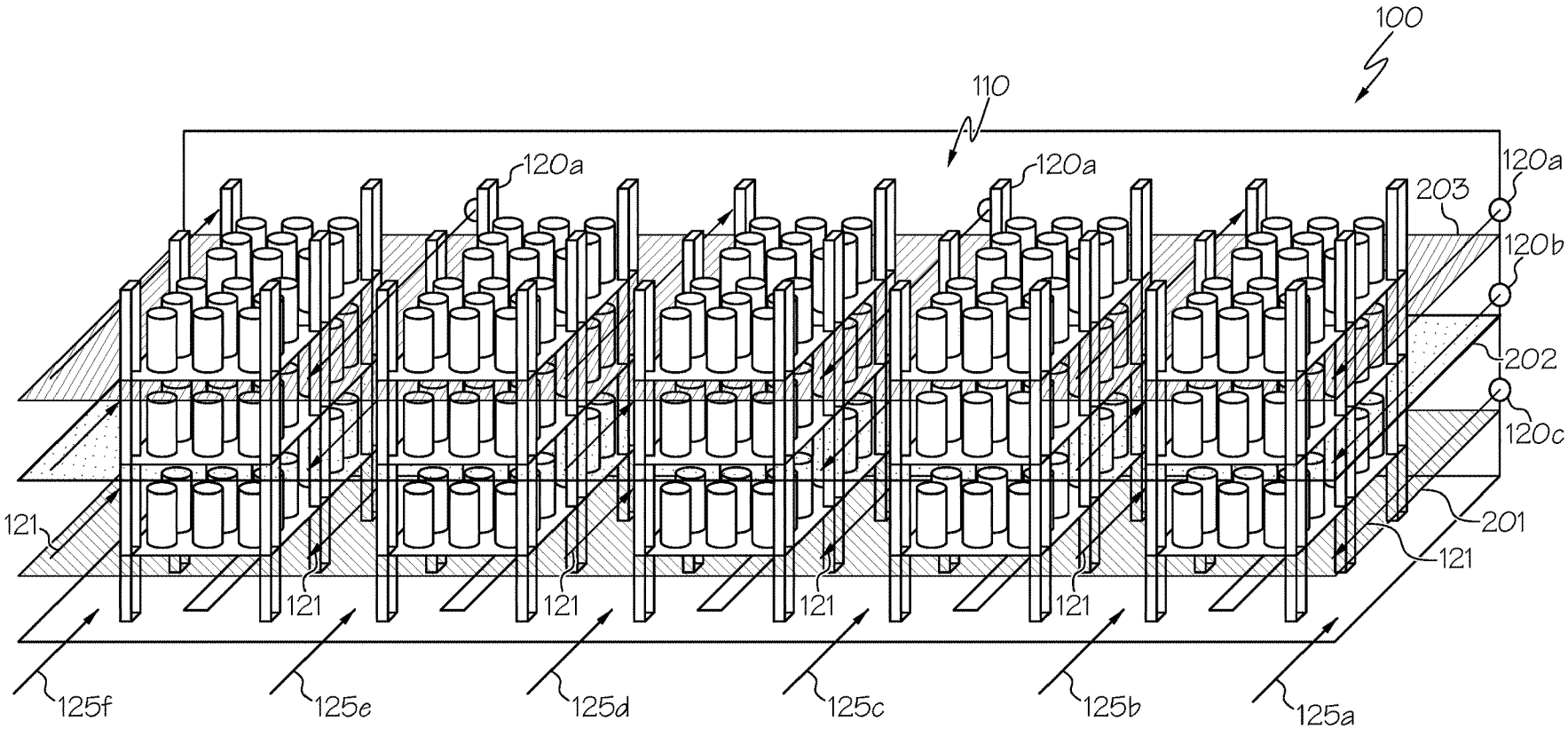
FIG. 3 schematically depicts a loaded periodic kiln having controlled temperature differentials oriented in a first direction according to embodiments disclosed and described herein.

In the embodiment shown in FIG. 2, beneath each stack 102 is a flue opening 103. The flue openings 103 allow gasses to be exhausted from the periodic kiln 100. For example, fuel is consumed and exhaust gas is created that needs to exit the periodic kiln 100. In addition to exhaust gas, volatile organic compounds (VOCs) are released from the ware when the ware is heated from ambient temperature to a degradation temperature. The combustion of VOCs in the ware space is an exothermic reaction and can cause uncontrolled heating of portions of the ware space 110. The fluids, such as VOCs or fuel, may be exhausted through the flue openings 103. Although FIG. 2 depicts flue openings 103 beneath each stack 102, according to some embodiments, the flue openings 103 may be located at any position in the periodic kiln 100. The number of flue openings 103 may vary depending on the airflow needs of the periodic kiln 100 and firing cycles and is not limited to the number of flue openings 103 shown in FIG. 2. Further, the embodiment shown in FIGS. 1-3 are directed to down draft periodic kilns 100 where ambient gasses—such as air for example—are injected into the periodic kiln 100 through the crown 100*c*, burners 120, or other inlet openings (not shown), flows through the ware space 110, and exits through the flue openings 103 in the hearth 100*a*. However, other embodiments comprise periodic kilns having other gas flow patterns, such as a gas flow pattern where ambient gas flows into the periodic kiln through the front wall 100*e* and exits the periodic kiln through the back wall 100*f* Thus, it should also be understood that, in embodiments, the flue openings 103 may be located in a different portion of the periodic kiln. For instance, in embodiments, the flue openings may be located in the crown 100*c*, the first sidewall 100*b*, the second sidewall 100*d*, the front wall 100*e*, and/or the back wall 100*f*.

In addition to the exhaust gas exiting the periodic kiln through the flue openings 103, other gases, such as air, nitrogen, $CO_2$, etc. may enter the periodic kiln through ducts (not shown). The ducts may be located in any surface of the periodic kiln 100 that does not comprise the flue openings. For instance, in the embodiment shown in FIG. 2, the ducts may be located in the crown 100*c*, the first sidewall 100*b*, the second sidewall 100*d*, the back wall 100*f*, the front wall 100*e*, or integral to the burners. In embodiments, the ducts may be positioned in opposing surfaces of the periodic kiln from the flue openings 103 so that the ambient gas flows from the ducts to the flue openings 103. For example, in embodiments ducts may be located in the crown 100*c*, which is opposite the hearth 100*a*, so that ambient gas flows into the periodic kiln from the ducts in the crown 100*c* and is exhausted at the flue openings 103 located at the hearth 100*a*. The number of ducts is not limited and may vary based upon airflow needs of the periodic kiln 100 and the firing cycle.

In embodiments, the ware space 110 is heated by burners 120. In the embodiment depicted in FIG. 2, the burners 120 are located in the first sidewall 100*b*. However, in embodiments the burners 120 may be located in any of the surfaces of the periodic kiln 100. As shown in the embodiment of FIG. 2, the burners 120 ignite combustion gas and form corresponding heat sources 121 that extend from the first sidewall 100*b* toward the second sidewall. In embodiments, the heat sources 121 extend through fire lanes 125 positioned between the stacks 102. The fire lanes 125 extend from the hearth 100*a* to the crown 100*c*. In embodiments, the heat sources 121 extend through the fire lanes 125 and span the entire distance between the first sidewall 100*b* and the second sidewall. In embodiments, a fire lane 125 is present between each stack 102. Burners 120 or electrically resistive radiating elements may be positioned so that one or more heat sources 121 extend through each fire lane 125 or so that one or more heat sources 121 extend through any subset of fire lanes 125. In other embodiments burners 120 are positioned in each fire lane 125 so that one or more heat sources 121 extend through each fire lane 125, as is shown in FIGS. 2 and 3. In embodiments, and with reference to FIGS. 2 and 3, columns of burners are alternately positioned on the first sidewall 100*b* and the second sidewall 100*d*. For instance, the columns of burners located in fire lanes 125*a*, 125*c*, and 125*e* are positioned in the first sidewall 100*b* and the columns of burners located in fire lanes 125*b*, 125*d*, and 125*f* are positioned in the second sidewall 100*d*. Further, in embodiments alternating burners within a single column may be positioned on opposing sidewalls. Although not depicted in FIGS. 2 and 3, as an example of such embodiments, a column comprising three burners may have a first burner nearest the crown 100*c* positioned on the first sidewall 100*b*, a second burner nearest the hearth 100*a* positioned on the first sidewall 100*b*, and third burner between the first and second burners positioned on the second sidewall 100*d*. Any of the above burner configurations, and other similar burner configurations, are envisioned by embodiments.

The embodiments shown in FIG. 2 have a column of three burners 120*a*, 120*b*, 120*c*, where 120*a* is nearest the crown 100*c*, 120*c* is nearest the hearth 100*a*, and 120*b* is positioned between 120*a* and 120*c* near the vertical middle of the ware space 110. In other embodiments that more or less than three burners 120 are in a column and that burners located between the top and bottom may have uneven or non-uniform spacing. For instance, in embodiments, two burners are in a column, and in other embodiments four or five burners are in a column. The number and size of burners and their flow or counter-flow direction in a column is determined by the level of control needed over any temperature stratification in the ware space 110 and the control over how quickly to heat the ware space 110. The more burners 120 that are in the column, the more control there is over both temperature stratification and overall heating of the ware space 110.

In embodiments, control thermocouples (not shown) are positioned on the second sidewall opposite each burner 120. For example, in embodiments where there is a column of three burners 120, the thermocouples measure the temperature of the corresponding heat source 121 that extends through a fire lane 125 from the burner 120 in the first sidewall 100*b* to the second sidewall 100*d*. The amount of air and fuel and the ratio thereof that is fed to the burner 120 may be adjusted to increase or decrease the temperature of the corresponding heat source 121. Thereby, the temperature outputs of the burners 120 may be modified. In some embodiments the temperature setpoint for each burner 120 may be separately and individually controlled. For example, the temperature setpoint of burner 120*a* may be the same as or different from the temperature setpoint of burner 120*b*, and the temperature setpoint of burner 120*c* may be the same as or different from the temperature setpoints of burners 120*a* and 120*b*. In other embodiments, the temperature setpoints of groups of burners 120 may be controlled together. For example, the temperature setpoint of all burners 120*a* positioned near the top of the ware space 110 may be set to a first temperature, the temperature setpoint of all burners 120*b* positioned near the vertical middle of the ware space 110 may be set to a second temperature that is the same as or different from the first temperature, and the setpoint of all burners 120*c* nearest the hearth 100*a* may be set to a third temperature that is the same as or different from the first and second temperature setpoints. In embodiments, the burners are grouped in any configuration that will provide the desired control of the temperature within the ware space 110.

In some embodiments, there are no thermocouples positioned opposite the burners 120 to measure the temperature of the corresponding heat source 121. In such embodiments, the temperature of a heat source 121 may be calculated by the amount of combustion gas fed to the corresponding burner 120 or by the combustion gas to oxygen ratio fed to the corresponding burner 120. In some embodiments, the source of oxygen is air. In other embodiments, industrial grade $O_2$ is used as the oxygen source. As such, if the temperature of a heat source is to be reduced or increased, the amount of fuel or the fuel to oxygen ratio for the corresponding burner 120 may be increased or decreased accordingly to affect the desired temperature increase or decrease of the heat source 121 corresponding to that burner. In embodiments, the fuel or oxygen to fuel ratio fed to each burner may be separately and individually controlled so that the temperature of each heat source 121 may be individually controlled. Or, in other embodiments, the amount of fuel or oxygen to fuel ratio may be controlled by groups of burners, such as the groups of burners described above, so that the temperature of heat sources generated by a group of burners is about the same.

According to embodiments, one way to regulate VOC release is to control the temperature in various temperature control zones of the ware space 110. For instance, as the firing cycle continues, the buoyancy of the heat causes the top of the ware space to have a higher temperature. This allows the VOCs to be released at the top of the ware space sooner than a target time, the VOCs are released at the middle of the ware space at the target time; the VOCs are formed at the bottom of the ware space later than a target time. By controlling the formation of the VOCs in this manner, the total formation of VOCs is the same as if all temperature control zones were at the same setpoint, but peak concentrations are reduced. Reducing peak concentrations of the VOCs reduces the need for additional volumes of dilution gas, and allows for faster heating rates.

Embodiments for regulating the temperature in temperature control zones of the ware space will be described now with reference to the embodiment depicted in FIG. 3. As shown in FIG. 3, burners 120 are positioned to emit heat sources 121 into each fire lane 125. The ware space 110 is divided into three temperature control zones 201, 202, 203 located near the bottom, in the vertical middle, and near the top of the ware space, respectively. Although FIG. 3 depicts three temperature control zones 201, 202, 203, in embodiments more or less temperature control zones may be present. In some embodiments, the ware space may be divided into two temperature control zones. In other embodiments, the ware space may be divided into four or five temperature control zones. Additionally, FIG. 3 shows the temperature control zones 201, 202, 203 in a vertical configuration in which one temperature control zone is located above or below another temperature control zone. This configuration may be used in a down draft periodic kiln where airflow travels from the crown 100*c* of the periodic kiln 100 to the hearth 100*a* of the periodic kiln. It may also be used in an updraft kiln where exhaust gases are vented through the crown.

In embodiments, each temperature control zone within the ware space 110 is controlled by a row of burners that corresponds to the temperature control zone. Referring to FIG. 3, a row of six burners 120*a* is located near the top of the ware space 110 and corresponds to temperature control zone 203. Accordingly, in embodiments each burner 120*a* in the row is set to emit a heat source that maintains the desired temperature of temperature control zone 203. Likewise, a row of six burners 120*b* is located in the vertical middle of the ware space 110 and corresponds to temperature control zone 202. Accordingly, in embodiments, each burner 120*b* in the row is set to emit a heat source that maintains the desired temperature of temperature control zone 202. The heat source emitted by the row of burners 120*a* near the top of the ware space may have the same or a different temperature than the heat source emitted from the row of burners 120*b* in the vertical middle of the ware space 110. Similarly, a row of six burners 120*c* is located near the bottom of the ware space 110 and corresponds to temperature control zone 201. Accordingly, in embodiments, each burner 120*c* in the row is set to emit a heat source that maintains the desired temperature of temperature control zone 201. The heat source emitted by the row of burners 120*c* near the bottom of the ware space may have the same or different temperature than the heat source emitted by either the row of burners 120*a* near the top of the ware space or the row of burners 120*b* in the vertical middle of the ware space.

Figure 4:
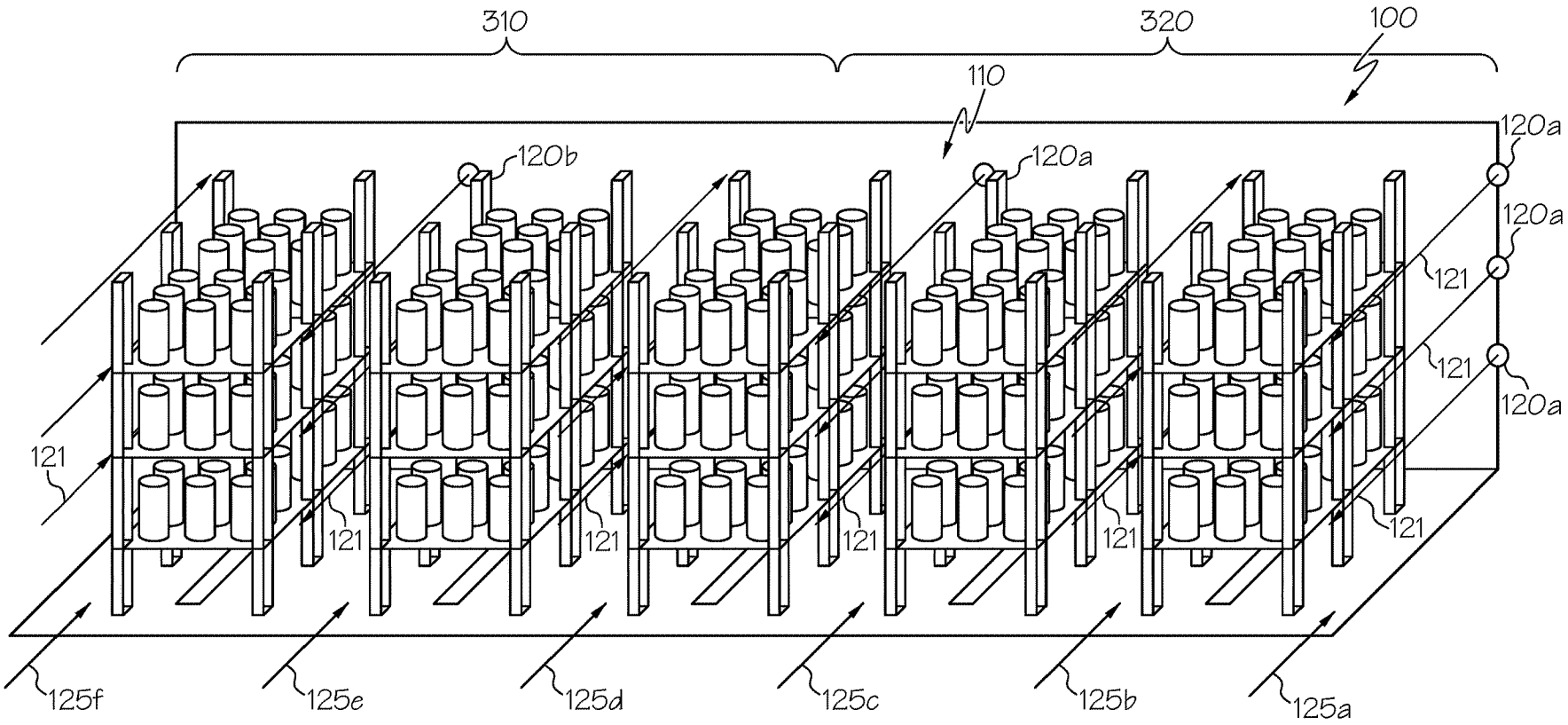
FIG. 4 schematically depicts a loaded periodic kiln having controlled temperature differentials oriented in a second direction according to embodiments disclosed and described herein.

In embodiments, and with reference now to FIG. 4, burners 120 are positioned to emit heat sources 121 into each fire lane 125. The ware space 110 is divided into two temperature control zones 310, 320 located adjacent to the back wall 100*f* and the front wall 100*e* of the ware space 110, respectively. Although FIG. 4 depicts two temperature control zones 310, 320, in embodiments more temperature control zones may be present. In some embodiments, the ware space 110 may be divided into three temperature control zones. In other embodiments, the ware space 110 may be divided into four temperature control zones. Additionally, FIG. 4 shows the temperature control zones 310, 320 in a horizontal configuration in which one temperature control zone is located beside another temperature control zone. This configuration may be used in a down draft periodic kiln where airflow travels from the crown 100*c* of the periodic kiln 100 to the hearth 100*a* of the periodic kiln. In other embodiments, the temperature control zones may have a vertical configuration in which a temperature control zone is located above or below another temperature control zone. This configuration may be used in a cross flow kiln where the airflow travels from the front wall 100*e* of the periodic kiln to the back wall of the periodic kiln or where the airflow travels from the back wall of the periodic kiln to the front wall 100*e* of the periodic kiln.

In embodiments, each temperature control zone 310, 320 within the ware space 110 is controlled by columns of burners that corresponds to the temperature control zone. Referring to FIG. 4, three columns of three burners each 120*a* are located near the front wall 100*e* of the ware space 110 and correspond to temperature control zone 320. In embodiments each burner 120*a* in the columns is set to emit a heat source that maintains the desired temperature of temperature control zone 320. Likewise, three columns of three burners each 120*b* is located near the back wall 100*f* of the ware space 110 and corresponds to temperature control zone 310. Accordingly, in embodiments, each burner 120*b* in the columns of burners is set to emit a heat source that maintains the temperature of temperature control zone 310. The heat source emitted by the row of burners 120*a* near the front wall 100*e* of the ware space 110 may have the same or a different temperature than the heat source emitted from the columns of burners 120*b* located near the back wall of the ware space 110. By dividing the ware space 110 into these two or more temperature control zones 310, 320, ware having different raw material characteristics can be finished in the same furnace. For instance, in embodiments, ware having a first set of material characteristics that require finishing at a first temperature may be finished in temperature control zone 310, while ware having a second set of material characteristics that require finishing at a second temperature—which is different than the first temperature—may be finished in temperature control zone 320.

In embodiments, the firing cycle for ware can be divided into two or more stages. In some embodiments, the firing cycle for ware is divided into three or more stages. In the first stage, the ware is heated from ambient temperature to a first temperature. In the second stage, the ware is heated from the first temperature to a second temperature. In the third stage, the ware is heated from the second temperature to a top soak temperature.

In embodiments, the ware is heated in first stage from ambient temperature to a first temperature that is from about 250° C. to about 700° C., such as from about 400° C. to about 650° C. In other embodiments, the first temperature is from about 575° C. to about 625° C., such as about 600° C. In the first stage, the firing cycle progresses through a temperature range in which organic material degrades and releases VOCs from the ware under the applied heat. Accordingly, in this first stage, temperature gradients may be created within the kiln space to control the release of VOCs.

Within the first stage, the ware space may be heated from ambient temperature to the first temperature in various sub-stages. For instance, in the first stage, the ware space may be heated from ambient temperature to a first sub-stage temperature that is less than the first temperature. The ware space may be held at the first sub-stage temperature for a duration of time. Subsequently, the ware space may be heated from the first sub-stage temperature to a second sub-stage temperature that is higher than the first sub-stage temperature and lower than the first temperature. The temperature of ware space may be held at the second sub-stage temperature for a duration of time. In embodiments, the first stage may comprise any number of sub-stages with or without holds and with or without change in heating rates between sub-stages.

In embodiments, the ware is heated in a second stage from the first temperature to a second temperature that is from about 600° C. to about 1000° C., such as from about 650° C. to about 950° C. In other embodiments, the second temperature is from 700° C. to about 900° C., such as from about 750° C. to about 850° C., or about 800° C. In the second stage intermediate reactions occur, such as dehydroxylation, pore former decomposition, etc.

As was the case in the first stage, in the second stage, the ware space may be heated from the first temperature to the second temperature in various sub-stages. For instance, in the second stage, the ware space may be heated from the first temperature to a first sub-stage temperature that is less than the second temperature. The ware space may be held at the first sub-stage temperature for a duration of time. Subsequently, the ware space may be heated from the first sub-stage temperature to a second sub-stage temperature that is higher than the first sub-stage temperature and lower than the second temperature. The temperature of ware space may be held at the second sub-stage temperature for a duration of time. In embodiments, the second stage may comprise any number of sub-stages. In embodiments, the ware is heated in a third stage from the second temperature to a top soak temperature that is from about 1200° C. to about 1550° C., such as from about 1250° C. to about 1400° C. In other embodiments, the top soak temperature is from about 1300° C. to about 1450° C. In the third stage, the properties of the green body are refined and the top soak temperature is tailored to the constituent raw materials and variability therein of those materials used to fabricate the ware. Properties affected may comprise ceramic phase, porosity, shrinkage and ware dimensions, or other properties.

As was the case in the first stage and second stage, in the third stage, the ware space may be heated from the second temperature to the top soak temperature in various sub-stages. For instance, in the third stage, the ware space may be heated from the second temperature to a first sub-stage temperature that is less than the top soak temperature. The ware space may be held at the first sub-stage temperature for a duration of time. Subsequently, the ware space may be heated from the first sub-stage temperature to a second sub-stage temperature that is higher than the first sub-stage temperature and lower than the top soak temperature. The temperature of ware space may be held at the second sub-stage temperature for a duration of time. In embodiments the third stage may comprise any number of sub-stages. In addition, the ware space may be held at the top soak temperature for a duration of time sufficient to impart the desired properties to the ware.

Methods for heating ware according to embodiments using the above described periodic kiln will now be described. In embodiments, the ware space is heated from an ambient temperature to a first temperature that is greater than the ambient temperature. During the heating of the ware space from the ambient temperature to the first temperature, a plurality of temperature control zones 201, 202, 203 oriented in a first direction have different setpoint temperatures, and a plurality of temperature control zones oriented in a second direction (not shown) have approximately the same setpoint temperature. In this example, the setpoint temperature anywhere within the first temperature control zone 201 will be the same and the setpoint temperature anywhere in the second temperature control zone 203 will be the same. However, the setpoint temperature in the first temperature control zone 201 may be the same or may not be the same as the temperature in the second temperature control zone 203. In embodiments, the third temperature control zone 202 may have a setpoint temperature that is the same as or different from the setpoint temperature of either the first temperature control zone 201 or the second temperature control zone 203.

In embodiments, the plurality of temperature control zones oriented in a first direction comprises three temperature control zones extending from a first wall 100*b* of the periodic kiln to a second wall of the periodic kiln 100*d*, such that a first temperature control zone is positioned next to a first wall of the periodic kiln, a second temperature control zone is positioned next to a second wall of the periodic kiln, and a third temperature control zone is positioned in the middle of the periodic kiln between the first temperature control zone and the second temperature control zone. For example, in embodiments during the heating of the ware space from ambient temperature to the first temperature, temperature control zones 201, 202, 203 oriented in a vertical direction, as shown in FIG. 3, each have different setpoint temperatures, and temperature control zones 310, 320 oriented in a horizontal direction, as shown in FIG. 4, have the same temperature. Put differently, in embodiments shown in FIG. 3 and FIG. 4, there is a setpoint temperature differential from the hearth of the periodic kiln to the crown of the periodic kiln, and the temperature stratification from the front wall 100*e* to the back wall 100*f* of periodic kiln is the approximately constant. In other embodiments, when the ware space is heated from ambient temperature to a first temperature, each of the temperature control zones 201, 202, 203 may have the same setpoint temperature.

In embodiments that comprise three temperature control zones when the ware space is heated from ambient temperature to a first temperature, and the third temperature control zone is positioned between the first temperature control zone and the second temperature control zone, each of the temperature control zones may have a different setpoint temperature. The setpoint temperature of the first temperature control zone may be from about 10° C. to about 50° C. greater than the setpoint temperature of the third temperature control zone, such as from about 15° C. to about 30° C. greater than the setpoint temperature of the third temperature control zone. In other embodiments, the setpoint temperature of the first temperature control zone may be from about 15° C. to about 25° C. greater than the setpoint temperature of the third temperature control zone, such as from about 17° C. to about 25° C. greater than the setpoint temperature of the third temperature control zone. In such embodiments, the setpoint temperature of the second temperature control zone may be from about 10° C. to about 50° C. less than the setpoint temperature of the third temperature control zone, such as from about 15° C. to about 30° C. less than the setpoint temperature of the third temperature control zone. In other embodiments, the setpoint temperature of the second temperature control zone may be from about 15° C. to about 25° C. less than the setpoint temperature of the third temperature control zone, such as from about 17° C. to about 20° C. less than the setpoint temperature of the third temperature control zone.

The ware space is subsequently heated from the first temperature to a second temperature that is greater than the first temperature. In some embodiments, during the heating of the ware space from the first temperature to the second temperature, the plurality of temperature control zones oriented in the first direction have different setpoint temperatures, and the plurality of temperature control zones oriented in the second direction have the same setpoint temperature. In embodiments in which the plurality of temperature control zones oriented in a first direction comprises three temperature control zones extending from one wall of the periodic kiln to a second wall of the periodic kiln, each of the three temperature control zones may have a different setpoint temperature. For example, in embodiments and with reference to FIG. 3, during the heating of the ware space from the first temperature to the second temperature, temperature control zones 201, 202, 203 oriented in a vertical direction each have a different setpoint temperature, and temperature control zones 310, 320 oriented in a horizontal direction as shown in FIG. 4 have approximately the same setpoint temperature. Put differently, in embodiments shown in FIG. 3 and FIG. 4, there is a setpoint temperature differential from the hearth of the periodic kiln to the crown of the periodic kiln, and the setpoint temperature from the front wall to the back wall of periodic kiln is the approximately constant.

In embodiments that comprise three temperature control zones during heating the ware space from the first temperature to the second temperature, where the third temperature control zone is positioned between the first and second temperature control zones, each of the temperature control zones may have a different setpoint temperature. In such embodiments, the setpoint temperature of the first temperature control zone may be from about 10° C. to about 50° C. greater than the setpoint temperature of the third temperature control zone, such as from about 15° C. to about 30° C. greater than the setpoint temperature of the third temperature control zone. In other embodiments, the setpoint temperature of the first temperature control zone may be from about 15° C. to about 25° C. greater than the setpoint temperature of the third temperature control zone, such as from about 17° C. to about 25° C. greater than the setpoint temperature of the third temperature control zone. In such embodiments, the setpoint temperature of the second temperature control zone may be from about 10° C. to about 50° C. less than the setpoint temperature of the third temperature control zone, such as from about 15° C. to about 30° C. less than the setpoint temperature of the third temperature control zone. In other embodiments, the setpoint temperature of the second temperature control zone may be from about 15° C. to about 25° C. less than the setpoint temperature of the third temperature control zone, such as from about 17° C. to about 20° C. less than the setpoint temperature of the third temperature control zone.

In yet other embodiments, during the heating of the ware space from the first temperature to the second temperature, the plurality of temperature control zones oriented in the first direction have the same setpoint temperature and the plurality of temperature control zones oriented in the second direction also have the same setpoint temperature. For example, in embodiments and with reference to FIG. 3, during the heating of the ware space from the first temperature to the second temperature, temperature control zones 201, 202, 203 oriented in a vertical direction each have approximately the same setpoint temperature, and temperature control zones 310, 320 oriented in a horizontal direction, as shown in FIG. 4, have approximately the same setpoint temperature. Put differently, in such embodiments, there is no applied or imposed setpoint temperature differential across the ware space.

The ware space is subsequently heated from the second temperature to a top soak temperature that is greater than the second temperature. In some embodiments, during the heating of the ware space from the second temperature to the top soak temperature, the plurality of temperature control zones oriented in the first direction have different setpoint temperatures, and the plurality of temperature control zones oriented in the second direction have approximately the same setpoint temperature. In embodiments in which the plurality of temperature control zones oriented in a first direction comprises three temperature control zones extending from one wall of the periodic kiln to a second wall of the periodic kiln, each of the three temperature control zones may have a different setpoint temperature. For example, in embodiments, during the heating of the ware space from the second temperature to the top soak temperature, temperature control zones 201, 202, 203 oriented in a vertical direction as shown in FIG. 3 each have a different setpoint temperature, and temperature control zones 310, 320 oriented in a horizontal direction as shown in FIG. 4 have approximately the same setpoint temperature. Put differently, in the embodiments shown in FIG. 3 and FIG. 4, there may be a temperature differential from the hearth of the periodic kiln to the crown of the periodic kiln, and the temperature from the front wall to the back wall of periodic kiln is the approximately constant.

In embodiments that comprise three temperature control zones during heating the ware space from the second temperature to the top soak temperature, where the third temperature control zone is positioned between the first and second temperature control zones, each of the temperature control zones may have a different temperature. In such embodiments, the setpoint temperature of the first temperature control zone may be from about 10° C. to about 50° C. greater than the setpoint temperature of the third temperature control zone, such as from about 15° C. to about 30° C. greater than the setpoint temperature of the third temperature control zone. In other embodiments, the setpoint temperature of the first temperature control zone may be from about 15° C. to about 25° C. greater than the setpoint temperature of the third temperature control zone, such as from about 17° C. to about 25° C. greater than the setpoint temperature of the third temperature control zone. In such embodiments, the setpoint temperature of the second temperature control zone may be from about 10° C. to about 50° C. less than the setpoint temperature of the third temperature control zone, such as from about 15° C. to about 30° C. less than the setpoint temperature of the third temperature control zone.

In other embodiments, the setpoint temperature of the second temperature control zone may be from about 15° C. to about 25° C. less than the setpoint temperature of the third temperature control zone, such as from about 17° C. to about 20° C. less than the setpoint temperature of the third temperature control zone.

In still other embodiments, during the heating of the ware space from the second temperature to the top soak temperature, the plurality of temperature control zones oriented in the first direction have the same setpoint temperature and the plurality of temperature control zones oriented in the second direction have different setpoint temperatures. For example, in embodiments and with reference to FIG. 3, during the heating of the ware space from the second temperature to the top soak temperature, temperature control zones 201, 202, 203 oriented in a vertical direction each have approximately the same setpoint temperature, and temperature control zones 310, 320 oriented in a horizontal direction as shown in FIG. 4 have different setpoint temperatures. Put differently, in such embodiments, there is a temperature differential across the ware space extending from the front wall to the back wall.

In such embodiments, the setpoint temperature of the second temperature control zone may be from about 3° C. to about 20° C. greater than the setpoint temperature of the first temperature control zone, such as from about 3° C. to about 15° C. greater than the setpoint temperature of the first temperature control zone. In other embodiments, the setpoint temperature of the second temperature control zone may be from about 3° C. to about 10° C. greater than the setpoint temperature of the first temperature control zone, such as from about 7° C. to about 10° C. greater than the setpoint temperature of the first temperature control zone.

In embodiments, the periodic kiln may be configured to supply dilution gas to each temperature control zone oriented in a first direction. In embodiments, the dilution gas may be air, nitrogen, or any other non-flammable gas. The flow rate of the dilution gas supplied to each temperature control zone may be individually varied. For example, and with reference to FIG. 3, a first flow rate of dilution gas may be supplied to temperature control zone 201, a second flow rate of dilution gas that is the same as or different from the first flow rate of dilution gas may be supplied to temperature control zone 202, and a third flow rate of dilution gas that is the same as or different from the first and second flow rate of dilution gas may be supplied to temperature control zone 203. In embodiments dilution gas may be supplied to the temperature control zones of the periodic kiln by any suitable mechanism, such as, for example, by forced gas flow through ducts fluidly connected to the periodic kiln (e.g. secondary gas nozzles incorporated into the burner in the periodic kiln).

In some embodiments, the VOC level is measured in some or many temperature control zones oriented in the first direction during the heating of the ware space from ambient temperature to the first temperature. For example, and with reference to FIG. 3, when the ware space is heated from ambient temperature to the first temperature, the VOC level is measured in one or more of temperature control zones 201, 202, and 203. The VOC level may be measured by any method. In such embodiments, a largest dilution gas flow rate is supplied to the temperature control zone having the highest concentration of VOCs, and the least gas flow rate is supplied to a temperature control zone having the lowest VOC concentration. For example, and with reference again to FIG. 3, if the highest VOC concentration is in temperature control zone 203, the highest dilution gas flow will be supplied to temperature control zone 203. Likewise, if the lowest VOC concentration is measured in temperature control zone 201, the least dilution gas flow will be supplied to temperature control zone 201. By supplying dilution gas in such a way, the concentration of VOCs in a specific temperature control zone may be diluted, thereby reducing the risk of runaway exothermic reactions in that temperature control zone. This method reduces excess volumes of secondary or dilution gas in portions of the kiln space not requiring them for VOC concentration dilution, and thereby reducing the excess energy needed to heat the dilution gases to the specified temperature in the kiln space or downstream in thermal after treatment.

Aspects of the disclosure will now be disclosed.

According to a first aspect, a method for firing ware in a periodic kiln comprises: positioning at least one stack of ware in a ware space of the periodic kiln, wherein the ware space comprises a plurality of temperature control zones that are oriented in a first direction, and a plurality of temperature control zones that are oriented in a second direction; heating the ware space in a first heating stage from an ambient temperature to a first temperature that is greater than the ambient temperature; heating the ware space in a second heating stage from the first temperature to a second temperature that is greater than the first temperature; and heating the ware space in a third heating stage from the second temperature to a top soak temperature that is greater than the second temperature, wherein at least one of the following conditions is satisfied: (i) during at least one of the first heating stage, the second heating stage, and the third heating stage, one temperature control zone of the plurality of temperature control zones that are oriented in the first direction has a setpoint temperature that is different from a setpoint temperature of at least one other temperature control zone of the plurality of temperature control zones that are oriented in the first direction; and (ii) during at least one of the first heating stage, the second heating stage, and the third heating stage, one temperature control zone of the plurality of temperature control zones that are oriented in the second direction has a setpoint temperature that is different from a setpoint temperature of at least one other temperature control zone of the plurality of temperature control zones that are oriented in the second direction.

A second aspect comprises the method of the first aspect, wherein the first direction is a vertical direction and the second direction is a horizontal direction.

A third aspect comprises a method of any of the first and second aspects, wherein the plurality of temperature control zones that are oriented in the first direction comprises a first temperature control zone adjacent to a hearth of the ware space, a second temperature control zone adjacent to a crown of the ware space, and a third temperature control zone between the first temperature control zone and the second temperature control zone.

A fourth aspect comprises a method of the third aspect, wherein during the first heating stage: a setpoint temperature of the first temperature control zone is from about 10° C. to about 50° C. less than the setpoint temperature of the third temperature control zone; and a setpoint temperature of the second temperature control zone is from about 10° C. to about 50° C. greater than the setpoint temperature of the third temperature control zone.

A fifth aspect comprises a method of the third aspect, wherein during the first heating stage: a setpoint temperature of the first temperature control zone is from about 15° C. to about 30° C. less than the setpoint temperature of the third temperature control zone; and a setpoint temperature of the second temperature control zone is from about 15° C. to about 30° C. greater than the setpoint temperature of the third temperature control zone.

A sixth aspect comprises a method of any of the first to fifth aspects, wherein the plurality of temperature control zones that are oriented in a second direction comprises a first temperature control zone adjacent to a front wall of the ware space and a second temperature control zone adjacent to a back wall of the ware space.

A seventh aspect comprises a method of the sixth aspect, wherein during the third heating stage, a setpoint temperature of the second temperature control zone is from about 3° C. to about 20° C. greater than the setpoint temperature of the first temperature control zone.

An eighth aspect comprises a method of the sixth aspect, wherein during the third heating stage, a setpoint temperature of the second temperature control zone is from about 3° C. to about 15° C. greater than the setpoint temperature of the first temperature control zone.

A ninth aspect comprises a method of any of the first to eighth aspects, wherein during the second heating stage: each temperature control zone of the plurality of temperature control zones that are oriented in the first direction has a same setpoint temperature, and each temperature control zone of the plurality of temperature control zones oriented in the second direction has a same setpoint temperature.

A tenth aspect comprises a method of any of the first to ninth aspects, wherein during the second heating stage: each temperature control zone of the plurality of temperature control zones that are oriented in the first direction has a different setpoint temperature, and each temperature control zone of the plurality of temperature control zones oriented in the second direction has a same setpoint temperature.

A eleventh aspect comprises a method of any of the first to tenth aspects, wherein the first temperature is from about 250° C. to about 700° C., the second temperature is from about 600° C. to about 1000° C., and the top soak temperature is from about 1200° C. to about 1550° C.

A twelfth aspect comprises a method of any of the first to eleventh aspects, further comprising supplying a dilution gas to each of the plurality of temperature control zones that are oriented in the first direction during the first heating stage, wherein the dilution gas has a different volumetric gas flow rate at each of the plurality of temperature control zones that are oriented in the first direction.

A thirteenth aspect comprises a method of any of the twelfth aspect further comprising: measuring or calculating a VOC level in each of the plurality of temperature control zones that are oriented in the first direction during the first heating stage; supplying a largest volumetric dilution gas flow rate of the dilution gas to a temperature control zone oriented in the first direction having a highest measured or calculated VOC level; and supplying a least volumetric dilution gas flow rate to a temperature control zone oriented in the first direction having a lowest measured or calculated VOC level.

A fourteenth aspect provides a method for firing ware in a down-draft periodic kiln, the method comprising: positioning at least one stack of ware in a ware space of the down-draft periodic kiln, wherein the ware space is defined by: a crown; a hearth opposite the crown; a first sidewall spanning between the crown and the hearth; a second sidewall opposite the first sidewall and spanning between the crown and the hearth; a front wall bounded by the first sidewall, the second sidewall, the hearth, and the crown; a back wall opposite the front wall and bounded by the first sidewall, the second sidewall, the hearth, and the crown; wherein the ware space comprises a plurality of temperature control zones that are oriented in a vertical direction; and a plurality of temperature control zones that are oriented in a horizontal direction; heating the ware space in a first heating stage from an ambient temperature to a first temperature that is greater than the ambient temperature, heating the ware space in a second heating stage from the first temperature to a second temperature that is greater than the first temperature; and heating the ware space in a third heating stage from the second temperature to a top soak temperature that is greater than the second temperature, wherein at least one of the following conditions is satisfied: (i) during at least one of the first heating stage, the second heating stage, and the third heating stage, one temperature control zone of the plurality of temperature control zones that are oriented in the vertical direction has a setpoint temperature that is different from a setpoint temperature of at least one other temperature control zone of the plurality of temperature control zones that are oriented in the vertical direction; and (ii) during at least one of the first heating stage, the second heating stage, and the third heating stage, one temperature control zone of the plurality of temperature control zones that are oriented in the horizontal direction has a setpoint temperature that is different from a setpoint temperature of at least one other temperature control zone of the plurality of temperature control zones that are oriented in the horizontal direction.

A fifteenth aspect comprises a method of the fourteenth aspect, wherein the first temperature is from about 250° C. to about 700° C., the second temperature is from about 600° C. to about 1000° C., and the top soak temperature is from about 1200° C. to about 1550° C.

A sixteenth aspect comprises a method of any of the fourteenth and fifteenth aspects, wherein the plurality of temperature control zones that are oriented in the vertical direction comprises a first temperature control zone adjacent to the hearth, a second temperature control zone adjacent to the crown, and a third temperature control zone between the first temperature control zone and the second temperature control zone, wherein during the first heating stage: a setpoint temperature of the first temperature control zone is from about 10° C. to about 50° C. less than the setpoint temperature of the third temperature control zone; and a setpoint temperature of the second temperature control zone is from about 10° C. to about 50° C. greater than the setpoint temperature of the third temperature control zone.

A seventeenth aspect comprises a method of any of the fourteenth to sixteenth aspects, wherein the plurality of temperature control zones that are oriented in the horizontal direction comprises a first temperature control zone adjacent to the front wall and a second temperature control zone adjacent to the back wall, wherein during the third heating stage a setpoint temperature of the second temperature control zone is from about 3° C. to about 15° C. greater than the setpoint temperature of the first temperature control zone.

An eighteenth aspect comprises a method of any of the fourteenth to sixteenth aspects, wherein during the second heating stage: each temperature control zone of the plurality of temperature control zones that are oriented in the vertical direction has a same setpoint temperature, and each temperature control zone of the plurality of temperature control zones oriented in the horizontal direction has a same setpoint temperature.

A nineteenth aspect comprises a method of any of the fourteenth to eighteenth aspects, wherein during the second heating stage: each temperature control zone of the plurality of temperature control zones that are oriented in the vertical direction has a different setpoint temperature, and each temperature control zone of the plurality of temperature control zones oriented in the horizontal direction has a same setpoint temperature.

A twentieth aspect comprises a method of any of the fourteenth to nineteenth aspects, further comprising: supplying a dilution gas flow to each of the plurality of temperature control zones that are oriented in the vertical direction during the first heating stage; and measuring or calculating a VOC level in each of the plurality of temperature control zones that are oriented in the vertical direction during the first heating stage, wherein a largest volumetric dilution gas flow rate is supplied to a temperature control zone oriented in the vertical direction having a highest measured or calculated VOC level; and a least volumetric dilution gas flow rate is supplied to a temperature control zone oriented in the vertical direction having a lowest measured or calculated VOC level.

Thus, embodiments disclosed herein may minimize or eliminate uncontrolled temperature differential and cracking within the ware. Additionally, variability in naturally occurring raw materials used for manufacturing the articles may be accommodated by using differing top soak temperatures in different areas of the kiln to ensure uniform physical properties within the fired bodies in a kiln load, if there are groups of ware or articles within the kiln space that were manufactured with different lots of raw materials or raw materials having degrees of variability, for example as may occur with naturally sourced raw materials.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A method for firing ware in a down-draft periodic kiln, the method comprising:

positioning at least one stack of ware in a ware space of the down-draft periodic kiln, wherein the ware space is defined by:

a crown;

a hearth opposite the crown;

a first sidewall spanning between the crown and the hearth;

a second sidewall opposite the first sidewall and spanning between the crown and the hearth;

a front wall bounded by the first sidewall, the second sidewall, the hearth, and the crown;

a back wall opposite the front wall and bounded by the first sidewall, the second sidewall, the hearth, and the crown;

a plurality of temperature control zones that are oriented in a vertical direction; and a plurality of temperature control zones that are oriented in a horizontal direction;

heating the ware space in a first heating stage from an ambient temperature to a first temperature that is greater than the ambient temperature, heating the ware space in a second heating stage from the first temperature to a second temperature that is greater than the first temperature; or heating the ware space in a third heating stage from the second temperature to a top soak temperature that is greater than the second temperature, wherein at least one of the following conditions is satisfied:

(i) during at least one of the first heating stage, the second heating stage, and the third heating stage, one temperature control zone of the plurality of temperature control zones that are oriented in the vertical direction has a setpoint temperature that is different from a setpoint temperature of at least one other temperature control zone of the plurality of temperature control zones that are oriented in the vertical direction; and (ii) during at least one of the first heating stage, the second heating stage, and the third heating stage, one temperature control zone of the plurality of temperature control zones that are oriented in the horizontal direction has a setpoint temperature that is different from a setpoint temperature of at least one other temperature control zone of the plurality of temperature control zones that are oriented in the horizontal direction.

2. The method of claim 1, wherein the first temperature is from about 250° C. to about 700° C., the second temperature is from about 600° C. to about 1000° C., and the top soak temperature is from about 1200° C. to about 1550° C.

3. The method of claim 1, wherein the plurality of temperature control zones that are oriented in the vertical direction comprises a first temperature control zone adjacent to the hearth, a second temperature control zone adjacent to the crown, and a third temperature control zone between the first temperature control zone and the second temperature control zone, wherein during the first heating stage:

a setpoint temperature of the first temperature control zone is from about 10° C. to about 50° C. less than the setpoint temperature of the third temperature control zone; and a setpoint temperature of the second temperature control zone is from about 10° C. to about 50° C. greater than the setpoint temperature of the third temperature control zone.

4. The method of claim 1, wherein the plurality of temperature control zones that are oriented in the horizontal direction comprises a first temperature control zone adjacent to the front wall and a second temperature control zone adjacent to the back wall, wherein during the third heating stage a setpoint temperature of the second temperature control zone is from about 3° C. to about 15° C. greater than the setpoint temperature of the first temperature control zone.

5. The method of claim 1, wherein during the second heating stage:

each temperature control zone of the plurality of temperature control zones that are oriented in the vertical direction has a same setpoint temperature, and each temperature control zone of the plurality of temperature control zones oriented in the horizontal direction has a same setpoint temperature.

6. The method of claim 1, wherein during the second heating stage:

each temperature control zone of the plurality of temperature control zones that are oriented in the vertical direction has a different setpoint temperature, and each temperature control zone of the plurality of temperature control zones oriented in the horizontal direction has a same setpoint temperature.

7. The method of claim 1, further comprising:

supplying a dilution gas flow to each of the plurality of temperature control zones that are oriented in the vertical direction during the first heating stage; and measuring or calculating a VOC level in each of the plurality of temperature control zones that are oriented in the vertical direction during the first heating stage, wherein a largest volumetric dilution gas flow rate is supplied to a temperature control zone oriented in the vertical direction having a highest measured or calculated VOC level; and a least volumetric dilution gas flow rate is supplied to a temperature control zone oriented in the vertical direction having a lowest measured or calculated VOC level.

* * * * *